US011896086B2

(12) United States Patent
DeVoe

(10) Patent No.: US 11,896,086 B2
(45) **Date of Patent: *Feb. 13, 2024**

(54) ARTICLE OF FOOTWEAR WITH EXTERNAL SUPPORT MEMBER

(71) Applicant: NIKE, Inc., Beaverton, OR (US)

(72) Inventor: DeVonne DeVoe, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 50 days.

This patent is subject to a terminal disclaimer.

(21) Appl. No.: 17/341,542

(22) Filed: Jun. 8, 2021

(65) Prior Publication Data

US 2021/0289880 A1 Sep. 23, 2021

Related U.S. Application Data

(63) Continuation of application No. 15/062,957, filed on Mar. 7, 2016, now Pat. No. 11,033,068.

(51) Int. Cl.
*A43B 7/1405* (2022.01)
*A43B 7/14* (2022.01)
(Continued)

(52) U.S. Cl.
CPC ..... *A43B 7/141* (2013.01); *A43B 7/142* (2013.01); *A43B 7/143* (2013.01); *A43B 7/144* (2013.01);
(Continued)

(58) Field of Classification Search
CPC ..... A43B 5/12; A43B 7/1405; A43B 7/141; A43B 7/142; A43B 7/1425; A43B 7/143; A43B 7/1435; A43B 7/144; A43B 7/1445; A43B 7/145; A43B 7/1495; A43B 7/18; A43B 13/026; A43B 13/12; A43B 13/141; A43B 13/22; A61F 5/14
(Continued)

(56) References Cited

U.S. PATENT DOCUMENTS 4,924,605 A 5/1990 Spademan
5,607,756 A 3/1997 Yamauchi et al.
(Continued)

FOREIGN PATENT DOCUMENTS

CN 104918508 A 9/2015
DE 202015106771 U1 1/2016
(Continued)

OTHER PUBLICATIONS

International Searching Authority, International Search Report and Written Opinion for International Application No. PCT/US2017/020931, dated Jun. 19, 2017.
(Continued)

*Primary Examiner* — F Griffin Hall
(74) *Attorney, Agent, or Firm* — Honigman LLP; Matthew H. Szalach; Jonathan P. O'Brien

(57) ABSTRACT

An article of footwear includes a dynamic support member that provides support to a foot. The support member is external to the article. The support member provides dynamic support by tightening around the foot when a user applies a strong enough force against a base portion of the support member. The support member includes several lateral gaps that facilitate increased flexibility for some portions of the support member.

19 Claims, 10 Drawing Sheets

(51) Int. Cl.

| | |
|---|---|
| ***A43B 23/22*** | (2006.01) |
| ***A43B 7/142*** | (2022.01) |
| ***A43B 7/1425*** | (2022.01) |
| ***A43B 7/143*** | (2022.01) |
| ***A43B 7/144*** | (2022.01) |
| ***A43B 7/1445*** | (2022.01) |
| ***A43B 13/12*** | (2006.01) |
| ***A43B 13/22*** | (2006.01) |

(52) U.S. Cl.
CPC ..... *A43B 7/1425* (2013.01); *A43B 7/1445* (2013.01); *A43B 7/1495* (2013.01); *A43B 13/12* (2013.01); *A43B 13/22* (2013.01); *A43B 23/22* (2013.01)

(58) Field of Classification Search
USPC ..... 36/140, 88, 91, 93, 145, 148, 166, 169, 36/8.3, 96, 147, 171; 602/66
See application file for complete search history.

(56) References Cited

U.S. PATENT DOCUMENTS

| | | | | |
|---|---|---|---|---|
| 5,692,319 | A | 12/1997 | Parker et al. | |
| 6,401,366 | B2 | 6/2002 | Foxen et al. | |
| 8,240,066 | B2 | 8/2012 | Logan | |
| 8,578,632 | B2 * | 11/2013 | Bell | A43C 1/04 36/88 |
| 8,584,378 | B2 | 11/2013 | Weidl et al. | |
| 8,667,713 | B2 | 3/2014 | Baudouin | |
| 11,033,068 | B2 * | 6/2021 | Devoe | A43B 13/22 |
| 2005/0183289 | A1 | 8/2005 | Neiley | |
| 2008/0052960 | A1 | 3/2008 | Belley et al. | |
| 2008/0178495 | A1 | 7/2008 | Stein et al. | |
| 2008/0289220 | A1 | 11/2008 | Rivas et al. | |
| 2013/0104422 | A1 | 5/2013 | Hatfield et al. | |
| 2014/0202044 | A1 | 7/2014 | Adami et al. | |
| 2014/0223779 | A1 | 8/2014 | Elder et al. | |
| 2015/0013185 | A1 * | 1/2015 | Elder | A43B 13/122 36/83 |
| 2016/0044988 | A1 | 2/2016 | Delgorgue et al. | |

FOREIGN PATENT DOCUMENTS

| | | | |
|---|---|---|---|
| EP | 752216 | A2 | 1/1997 |
| EP | 0815757 | A2 | 1/1998 |
| ES | 2257402 | T3 | 8/2006 |
| FR | 2853224 | A1 | 10/2004 |
| JP | H05115303 | A | 5/1993 |
| JP | 2006334400 | A | 12/2006 |
| WO | WO-2008008158 | A2 | 1/2008 |

OTHER PUBLICATIONS

China National Intellectual Property Administration, Notification of First Office Action for CN Application No. 201780016136.3, dated Apr. 16, 2020.
United States Patent and Trademark Office, Office Action for U.S. Appl. No. 15/062,957 dated Dec. 27, 2017.
United States Patent and Trademark Office, Office Action for U.S. Appl. No. 15/062,957 dated Jul. 26, 2018.
United States Patent and Trademark Office, Office Action for U.S. Appl. No. 15/062,957 dated Jul. 29, 2019.
United States Patent and Trademark Office, Office Action for U.S. Appl. No. 15/062,957 dated Jan. 29, 2020.
United States Patent and Trademark Office, Office Action for U.S. Appl. No. 15/062,957 dated Aug. 19, 2020.

* cited by examiner

ARTICLE OF FOOTWEAR WITH EXTERNAL SUPPORT MEMBER

CROSS-REFERENCE TO RELATED APPLICATION

This application is a continuation of U.S. patent application Ser. No. 15/062,957, filed Mar. 7, 2016, the disclosure of which is hereby incorporated by reference in its entirety.

BACKGROUND

The present embodiments relate generally to articles of footwear and in particular to articles of footwear with support members.

Athletic shoes have two major components, an upper that provides the enclosure for receiving the foot, and a sole secured to the upper. The upper may be adjustable using laces, hook-and-loop fasteners or other devices to secure the shoe properly to the foot. The sole has the primary contact with the playing surface. The sole may be designed to absorb the shock as the shoe contacts the ground or other surfaces. The upper may be designed to provide the appropriate type of protection to the foot and to maximize the wearer's comfort.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
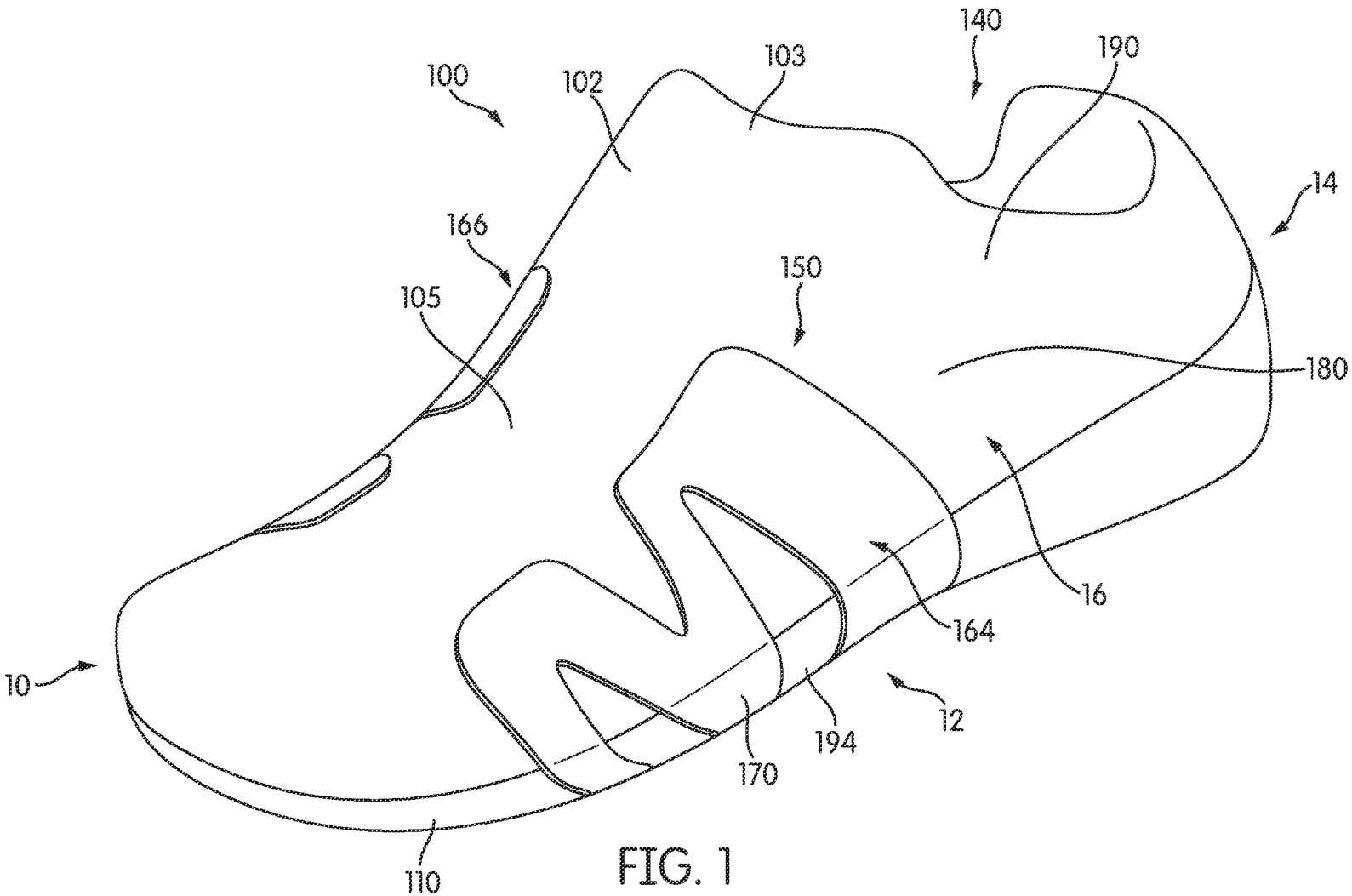
FIG. 1 is an isometric view of an embodiment of an article of footwear including a support member.

In one aspect, an article of footwear includes an upper and a sole structure. The article further includes a support member, where the support member is more rigid than the upper, and where the support member further includes a base portion, a first side portion, and a second side portion. The support member has a proximal side and a distal side, where the proximal side is disposed closer to a foot when the article of footwear is worn. The base portion has a convex geometry on the proximal side of the support member. A first lateral gap separates a front portion of the base portion from an intermediate portion of the base portion and a second lateral gap separates the intermediate portion of the base portion from a rear portion of the base portion.

In another aspect, an article of footwear includes an upper and a sole structure and a support member, where the support member is more rigid than the upper. The support member further includes a base portion, a first side portion, and a second side portion. The support member has a forward most edge associated with the base portion, the first side portion and the second side portion and the support member has a rearward most edge associated with the base portion, the first side portion and the second side portion. The support member has a first side upper edge associated with the first side portion, where the first side upper edge extends from the forward most edge to the rearward most edge. The support member has a second side upper edge associated with the second side portion, where the second side upper edge extends from the forward most edge to the rearward most edge. A first lateral gap extends from the first side portion to the second side portion and through the base portion, and a first end portion of the first lateral gap is spaced apart from the first side upper edge and a second end portion of the first lateral gap is spaced apart from the second side upper edge. A second lateral gap extends from the first side portion to the second side portion and through the base portion, and where a first end portion of the second lateral gap is spaced apart from the first side upper edge and where a second end portion of the second lateral gap is spaced apart from the second side upper edge. A first side gap extends from the first side upper edge into the first side portion and where a second side gap extends from the second side upper edge into the second side portion.

In another aspect, an article of footwear includes an upper and a sole structure. The upper includes a first side outer surface and a second side outer surface. The article also includes a support member, where the support member is more rigid than the upper. The support member further includes a base portion, a first side portion, and a second side portion. The base portion is configured to provide support to a lower surface of a foot when the article of footwear is worn. The first side portion is configured to provide support to a first side of the foot when the article of footwear is worn. The second side portion is configured to provide support to a second side of the foot when the article of footwear is worn. The first side portion is disposed on the first side outer surface of the upper and the second side portion is disposed on the second side outer surface of the upper.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

FIG. 1 is illustrates a schematic isometric views of an embodiment of an article of footwear 100, also referred to simply as article 100. Article 100 may be configured for use with various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports related footwear, including, but not limited to: slippers, sandals, high heeled footwear, loafers as well as any other kinds of footwear, apparel and/or sporting equipment (e.g., gloves, helmets, etc.). In some embodiments, article 100 may be configured for use in athletic activities such as hammer throwing and javelin throwing.

Referring to FIG. 1, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18 (see FIG. 3). In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending along a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be used in describing components of an article. In other words, each individual component of an article may have a corresponding longitudinal direction, a lateral direction and a vertical direction.

Referring to FIGS. 1 through 4, article 100 may include an upper 102 as well as a sole structure 110. In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional.

Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, or a shoe designed for athletic activities such as hammer throwing or javelin throwing, upper 102 could be a low top upper.

In some embodiments, upper 102 includes opening 140 that provides entry for the foot into an interior cavity of upper 102. In the exemplary embodiment, upper 102 includes an integrated tongue portion 103 that bounds opening 140 in a forward direction. However, in other embodiments, opening 140 may extend further into instep portion 105 of upper 102. Furthermore, in some other embodiments, upper 102 may be configured with a fastening system to control the size of opening 140, using, for example, laces, snaps, hook and loop fasteners as well as other kinds of fasteners. In the exemplary embodiment, upper 102 may be constructed of a substantially elastic material that contracts around a foot when the foot is inserted into opening 140.

Figure 2:
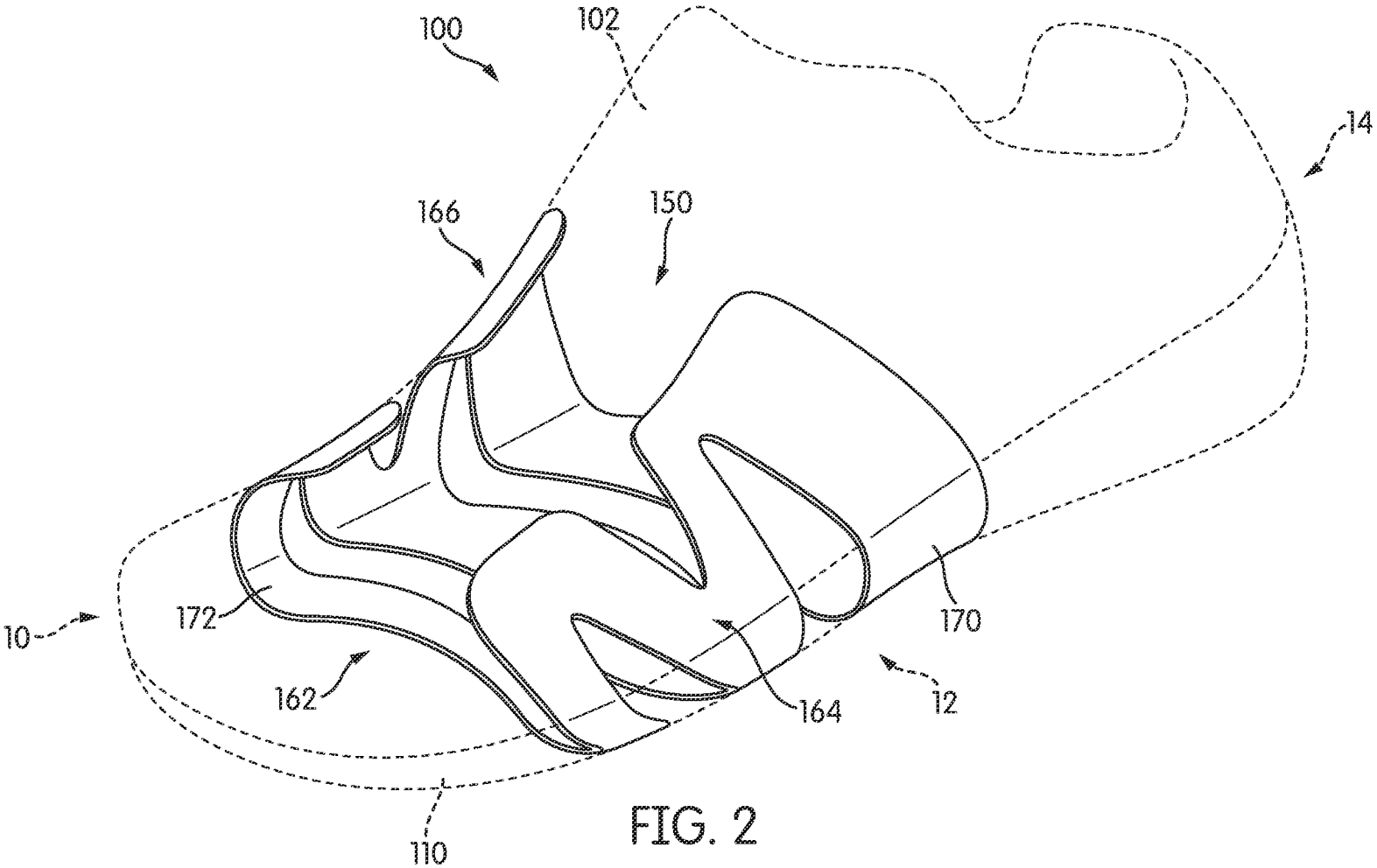
FIG. 2 is an isometric view of the article of footwear and support member of FIG. 1, in which an upper and sole structure of the article of footwear are shown in phantom.
Figure 3:
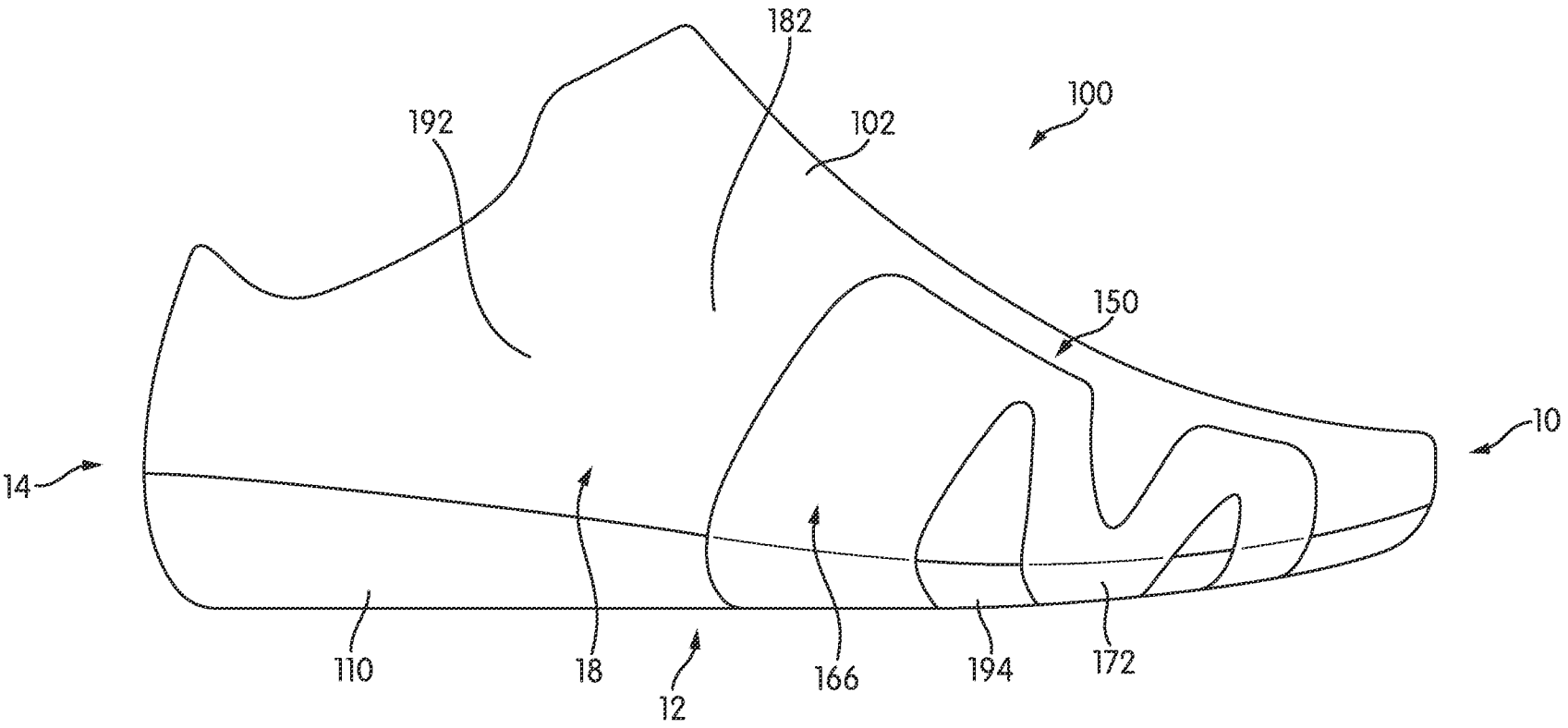
FIG. 3 is a side view of an embodiment of an article of footwear including a support member.

FIGS. 1-3 illustrate various views of article 100 in which a support member 150 is clearly visible. In particular, FIG. 2 illustrates a schematic isometric view of article 100 in which upper 102 and sole structure 110 are shown in phantom, while FIG. 3 illustrates a medial side view of article 100. In some embodiments, support member 150 may extend through portions of article 100 in order to facilitate additional support of article 100 during use. As discussed in further detail below, support member 150 may include provisions to enhance the stability of article 100 while a user goes through a throwing motion in athletic events such as the hammer throw or the javelin throw, which require the user's foot to be stably planted on the ground during the release phase of the throw.

Referring to FIGS. 1-3, support member 150 may comprise a base portion 162, a first side portion 164 and a second side portion 166. Base portion 162 may intersect first side portion 164 at first side periphery 170. In other words, base portion 162 may be joined, attached, or otherwise associated with, first side portion 164 at first side periphery 170. Likewise, base portion 162 may intersect second side portion 166 at second side periphery 172. In other words, base portion 162 may be joined, attached, or otherwise associated with, second side portion 166 at second side portion 172.

In general, first side portion 164 and second side portion 166 may extend away from base portion 162. In some embodiments, first side periphery 170 may be curved or angled so that first side portion 164 is generally not parallel with base portion 162. Likewise, in some embodiments, second side periphery 172 may be curved or angled so that second side portion 166 is generally not parallel with base portion 162. In some cases, the orientation of first side portion 164 and second side portion 166, with respect to base portion 162, is in an approximately vertical direction.

Base portion 162 may be generally configured to provide support for the lower surface, or sole, of a foot when article 100 is worn. In particular, in some cases, base portion 162 may be disposed beneath the sole, or between the sole and a ground surface during use. As discuss in detail below, in some embodiments, one or more layers or structures of article 100 may be disposed between the foot and base portion 162 of support member 150. In other embodiments, however, a foot may directly contact base portion 162.

In some embodiments, first side portion 164 and second side portion 166 may be arranged so that first side portion 164 extends along a first side 180 (i.e., lateral side 16 in the exemplary embodiment) of article 100 while second side portion 166 extends along a second side 182 (i.e., medial side 18 in the exemplary embodiment) of article 100.

Figure 12:
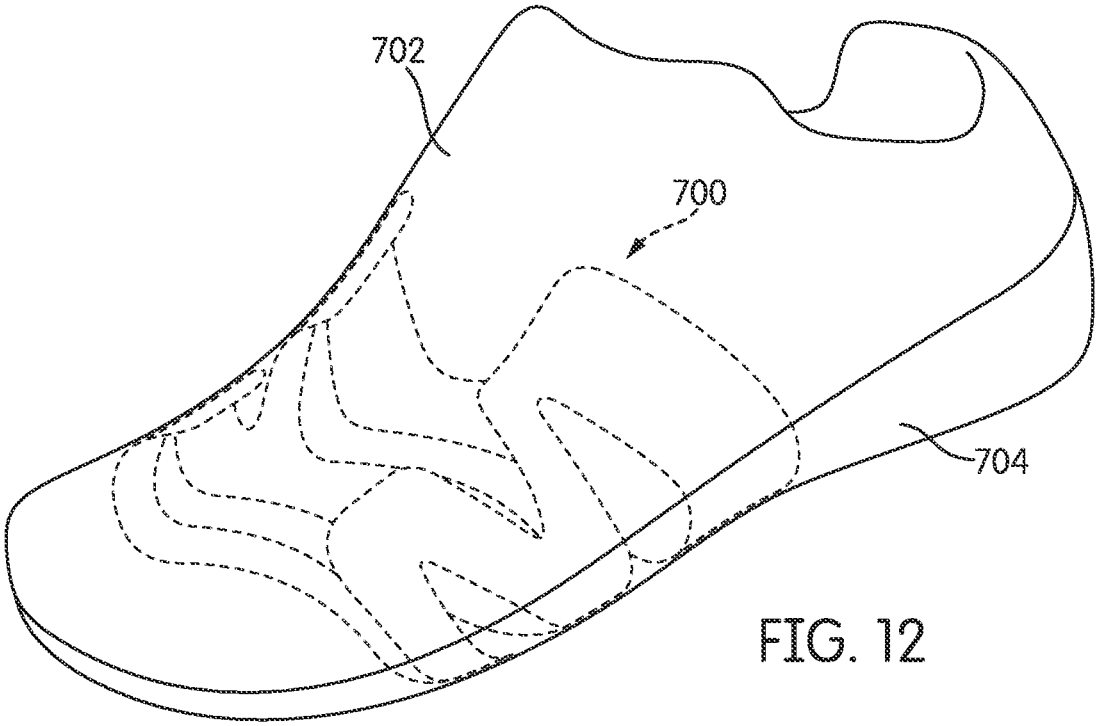
FIG. 12 is a schematic isometric view of another embodiment of an article of footwear and a support member, in which the support member is disposed within an upper and a sole structure of the article of footwear.
Figure 13:
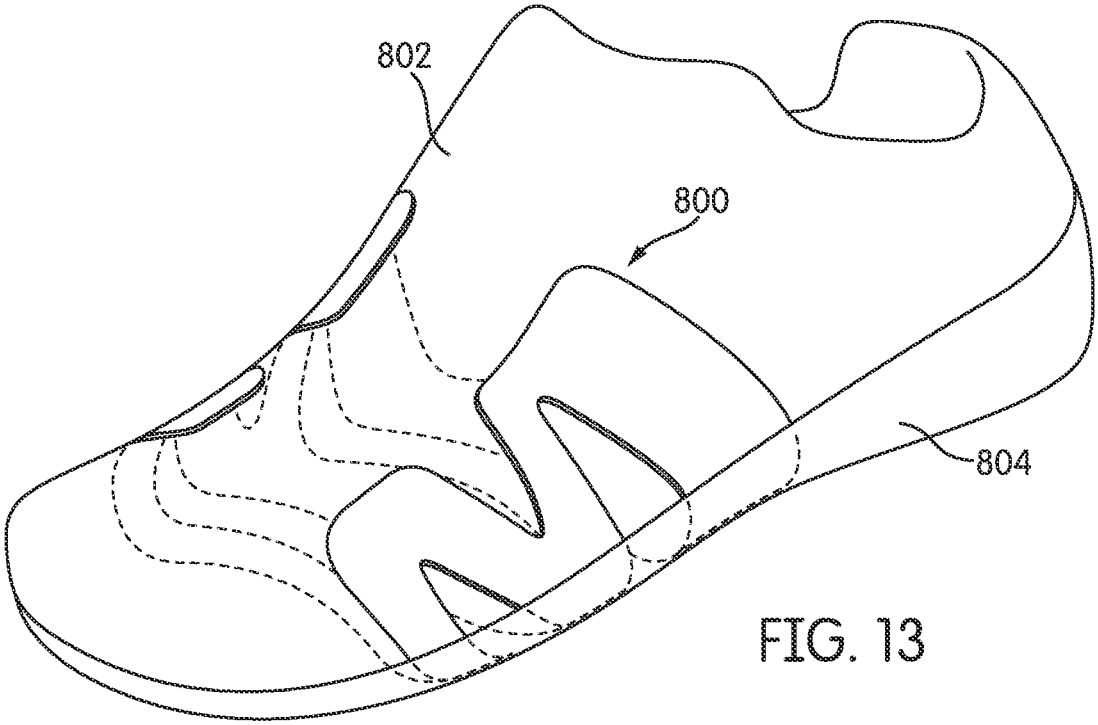
FIG. 13 is a schematic isometric view of another embodiment of an article of footwear and a support member, in which the support member is disposed externally on an upper and internally within a sole structure of the article of footwear.

In different embodiments, the relative location of support member 150 on article 100 may vary. In some embodiments, support member 150 could be an external support member, which may be disposed on an exterior surface of upper 102 and/or sole structure 110. In other embodiments, support member 150 could be an internal support member that is disposed within the external surfaces of upper 102 and sole structure 110. In still other embodiments, some portions of support member 150 may be external to article 100, while other portions could be internal. The exemplary embodiment illustrates an example of a fully external support member. However, alternative configurations are described in further detail below and shown in FIGS. 12 and 13.

Upper 102 may include first side outer surface 190 and second side outer surface 192. In the exemplary embodiment, first side outer surface 190 and second side outer surface 192 may be lateral and medial outer surfaces, respectively. In some embodiments, sole structure 110 may also have an outer sole surface 194. In some cases, outer sole surface 194 may comprise all of the outwardly facing surfaces of sole structure 110, including surfaces associated with both an outsole (which may face towards a ground) and midsole (which may not be ground facing).

In some embodiments, first side portion 164 of support member 150 may be disposed on first side outer surface 190, while second side portion 166 of support member 150 may be disposed on second side outer surface 192. In other words, first side portion 164 and second side portion 166 may be disposed over first side outer surface 190 and second side outer surface 192, respectively. Additionally, in some cases, base portion 162 may be disposed on outer sole surface 194. In other words, base portion 162 may be disposed between outer sole surface 194 and a ground surface when article 100 is in contact with the ground surface. Moreover, first side portion 164 and second side portion 166 may be characterized as being distal to upper 102, while base portion 162 may be characterized as being distal to sole structure 110.

In different embodiments, support member 150 may extend through various different portions of article 100, including, forefoot portion 10, midfoot portion 12 and/or heel portion 14. In an exemplary embodiment, support member 150 extends through some of forefoot portion 10 and some of midfoot portion 12. However, in other embodiments, support member 150 could extend into heel portion 14 as well. Moreover, in some cases, support member 150 could be a full length support member that extends through a majority of the length of article 100.

Generally, the relative material properties of upper 102, sole structure 110 and support member 150 could vary. For example, in some embodiments, support member 150 could have a greater rigidity than upper 102. In some embodiments, support member 150 could have a greater rigidity than sole structure 110. In other embodiments, however, support member 150 could be less rigid than sole structure 110. In still other embodiments, support member 150 could be less rigid than some or all of upper 102. In an exemplary embodiment, support member 150 is made of a material that is substantially more rigid than both upper 102 and sole structure 110. This arrangement allows support member 150 to provide increased strength for article 100.

In different embodiments, the material construction of support member 150 could vary. Exemplary materials that could be used to make support member 150 include, but are not limited to various kinds of plastics, metals, composite materials (such as carbon composite materials) as well as other kinds of materials. Moreover, support member 150 could have an integral or unitary construction in some embodiments. In other embodiments, support member 150 could be comprised of separate parts joined by adhesives, welding, or any kinds of fasteners. In some embodiments, support structure 150 may be comprised of a material and/or geometry providing a stiffness that enables the base portion of support structure 150 to flex and that further enables the first side portion and second side portion to flex in response to applying compressive forces to sole structure 100, with the compressive forces applied by a foot and an underlying substrate (e.g., the ground). An appropriate stiffness may be provided by varying the type of material and/or thickness of the material used in forming support structure 150. It may be appreciated that as support structure 150 has multiple degrees of freedom (i.e., of flexing), support structure 150 may in fact be characterized by a different value of stiffness along each degree of freedom (direction of flexing). Thus, a desired amount of stiffness in each of two or more different directions could be achieved by selecting the appropriate material and/or thickness of support structure 150.

Figure 4:
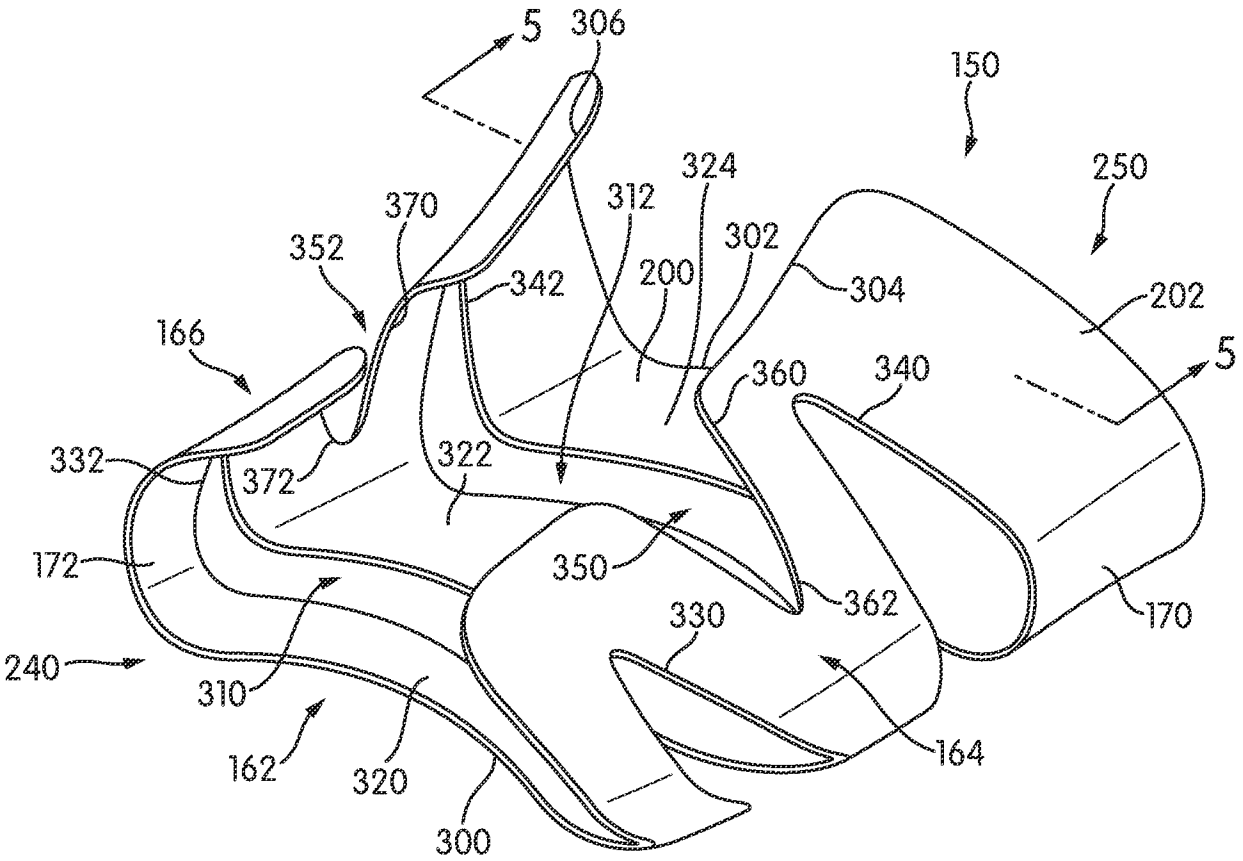
FIG. 4 is an isometric view of an embodiment of a support member.
Figure 5:
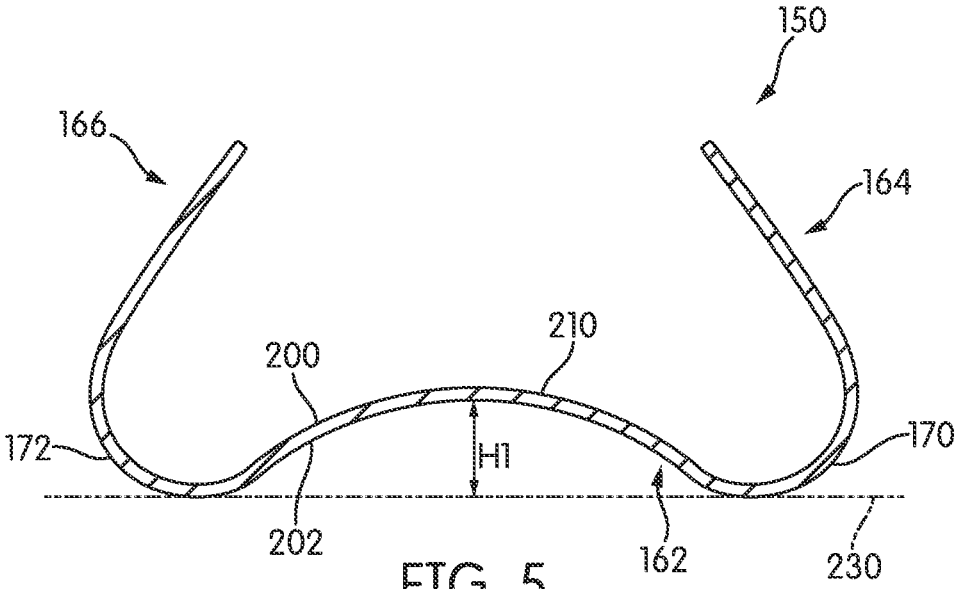
FIG. 5 is a schematic cross-sectional view of a portion of a support member.

FIGS. 4 and 5 illustrate an isometric view and a cross sectional view, respectively, of an embodiment of support member 150. Referring to FIGS. 4 and 5, support member 150 may be characterized as having a proximal side 200 and a distal side 202. Proximal side 200 may be disposed closer to a foot when article 100 is worn, while distal side 202 is disposed opposite of proximal side. In other words, proximal side 200 may be an inwardly facing side, while distal side 202 may be an outwardly facing side.

In some embodiments, the geometry of support member 150 can vary. In some embodiments, for example, base portion 162 may have an approximately convex geometry on proximal side 200. Likewise, base portion 162 may have an approximately concave geometry on distal side 202. Referring specifically to FIG. 5, an intermediate portion 210 of base portion 162 is seen to rise to a maximum height H1, as measured from a lower horizontal plane 230 that is tangential to the lowest portions of base portion 162.

In an exemplary embodiment, the height of base portion 162 may rise in a gradual manner from first side periphery 170 and from second side periphery 172. Moreover, in some cases, the change in height may be approximately symmetric about a lateral direction of support member 150. However, in other cases, the change in height may be more abrupt and/or asymmetric. The specific geometry of intermediate portion 210 may be varied in order to tune the flexing properties of support member 150, which are described in further detail below.

In some embodiments, the height of base portion 162 above horizontal plane 230 may vary along the lateral direction of support member 150, but may stay approximately constant over different longitudinal positions. In other words, in some embodiments, the cross sectional geometry of base portion 162 could be substantially similar across different longitudinal positions of support member. In other embodiments, however, the height of base portion 162 above horizontal plane 230 may vary in the longitudinal direction. For example, in one embodiment, the maximum height of base portion 162 may increase from a forward portion of support member 150 to a rearward portion of support member 150. Such a variation in maximum height may provide a better fit with base portion 162 at the forefoot and arch of the sole.

It will be understood that in other embodiments, the geometry of base portion 162 could vary in any other manner. For example, in some embodiments, base portion 162 could have a concave geometry on proximal side 200. In still other embodiments, base portion 162 could have an approximately flat or straight geometry on proximal side 200.

In some embodiments, the geometry of first side portion 164 and second side portion 166 may also vary. In some cases, the curvature of first side portion 164 and second side portion 166 could be substantially different from the curvature of base portion 162. In some embodiments, first side portion 164 and second side portion 166 may each have approximately flattened, or straight, geometries on proximal side 200 of support member 140. In some embodiments, first side portion 164 and second side portion 166 may have approximately convex geometries on proximal side 200 of support member 150. In an exemplary embodiment, first side portion 164 and second side portion 166 have approximately concave curvature on proximal side 200, especially near first side periphery 170 and second side periphery 172, respectively. This configuration may help first side portion 164 and second side portion 166 to cradle or support the sides of a foot when article 100 is worn.

As seen in FIG. 4, the height of support member 150 may also vary from a forward end portion 240 to a rearward end portion 250 of support member 150. For example, in some embodiments, rearward end portion 250 may have a greater height in the vertical direction than forward end portion 240. Moreover, in some embodiments, the height of support member 150 may gradually decrease from rearward end portion 250 towards forward end portion 240 in a manner that conforms to the natural slope of the instep of the foot.

Figure 6:
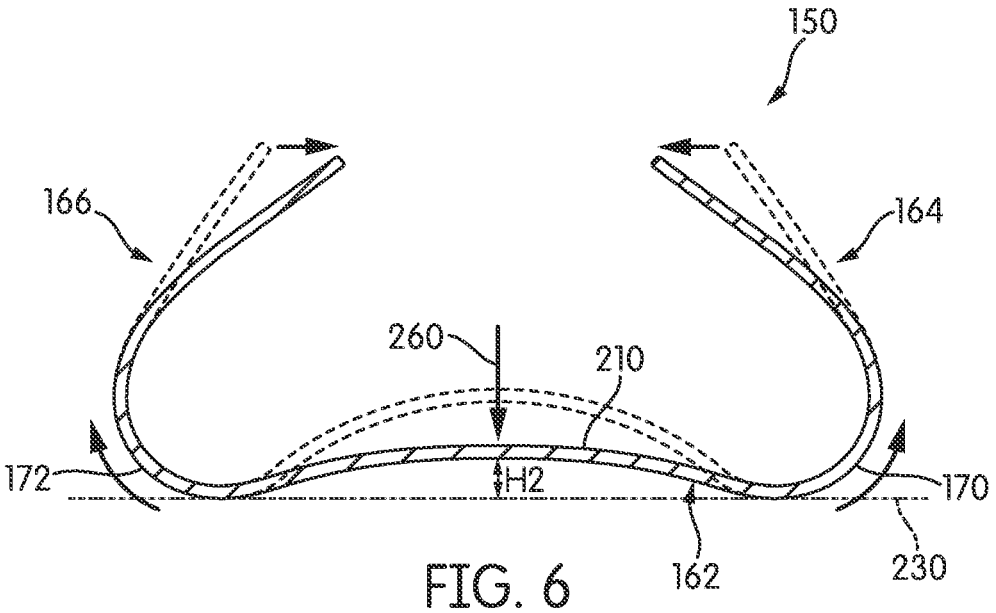
FIG. 6 is a schematic cross-sectional view of a portion of a support member as a downward force is applied to a base portion of the support member.

FIGS. 5 and 6 illustrate how the lateral cross-sectional geometry of support member 150 helps support member 150 to operate in at least two support configurations. In a default, non-flexed, or non-actuated, configuration, base portion 162 retains its convex geometry on proximal side 200. In this configuration, first side portion 164 and second side portion 166 may be disposed against the sides of upper 102, but they do not apply any significant forces against the foot. However, as seen in FIG. 6, which illustrates a flexed or actuated configuration of support member 150, a normal force applied to base portion 162 may cause first side portion 164 and second side portion 166 to squeeze inwardly on upper 102 (and a foot). Specifically, normal force 260 acts to partially flatten intermediate portion 210 of base portion 162, until intermediate portion 210 has a maximum height of H2 above horizontal plane 230. As seen in comparing FIG. 5 to FIG. 6, height H2 is substantially less than height H1. As intermediate portion 210 is flattened, normal force 260 is transmitted to first side periphery 170 and second side periphery 172 of support member 150. At first side periphery 170 and second side periphery 172, the transmitted force acts to rotate first side portion 164 and second side portion 166 inwardly. This causes an inward clamping force against upper 102 and the foot, thereby increasing the stability of the foot within article 100.

It will be understood that while FIGS. 5 and 6 illustrate the geometry of a rearward portion of support member 150 in different configurations, similar changes in geometry may occur at other portions of support member 150.

Support member 150 may be provided with a geometry that provides enhanced stability without limiting motion. In some embodiments, therefore, support member 150 may include various provisions to maintain increased flexibility during use of article 100. Exemplary features to promote flexibility can include various gaps, slots, etc.

Figure 7:
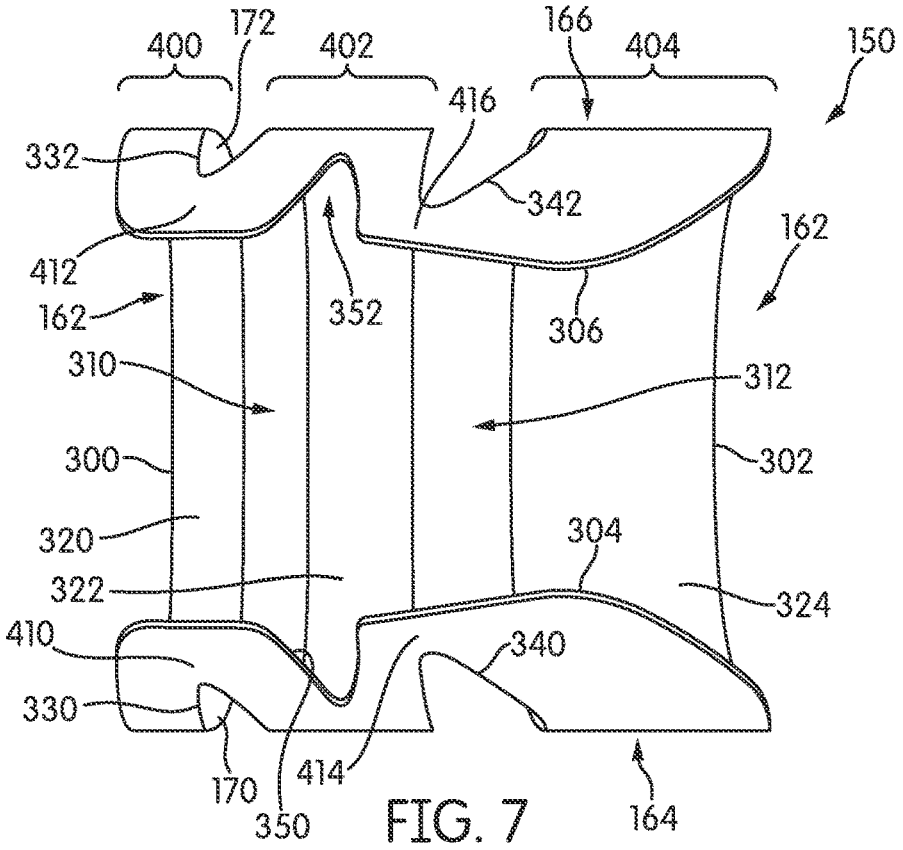
FIG. 7 is a top down view of an embodiment of a support member.
Figure 8:
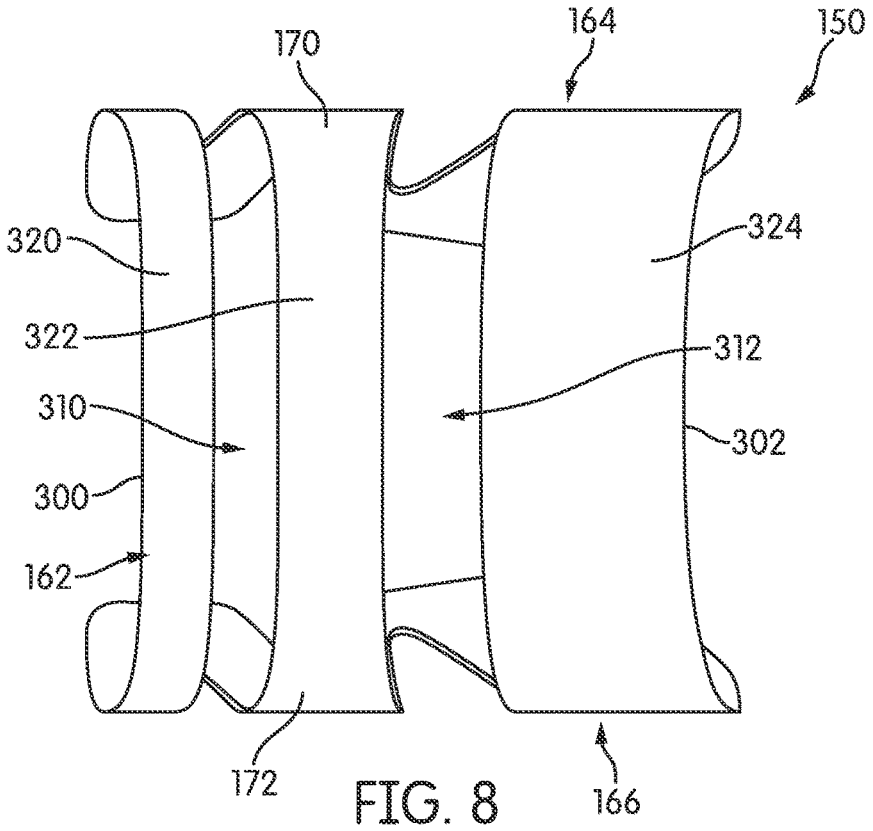
FIG. 8 is a bottom view of an embodiment of a support member.

FIGS. 7 and 8 illustrate top and bottom views, respectively, of an embodiment of support member 150. Referring now to FIGS. 4, 7 and 8, support member 150 may be characterized as comprising various edges or outermost boundaries. In some embodiments, support member 150 may include forward most edge 300, which is comprised of the forward most edges of base portion 162, first side portion 164 and second side portion 166. Likewise, in some embodiments, support member 150 may include rearward most edge 302, which is comprised of the rearward most edges of base portion 162, first side portion 164 and second side portion 166. In addition, in some embodiments, support member 150 can include a first side upper edge 304 that is associated with first side portion 164 and second side upper edge 306 that is associated with second side portion 166. First side upper edge 304 may extend from forward most edge 300 to rearward most edge 302 on a first side of support member 150. Also, second side upper edge 306 may extend from forward most edge 300 to rearward most edge 302 on a second side of support member 150.

In some embodiments, support member 150 may include one or more gaps, slots, openings, apertures or other kinds of holes. In an exemplary embodiment, support member 150 may be configured with one or more lateral gaps, which may extend in an approximately lateral direction (i.e., widthwise direction) through support member 150. Referring to FIGS. 4, 7 and 8, support member 150 includes first lateral gap 310 and second lateral gap 312. First lateral gap 310 may extend from first side portion 164, through base portion 162 and into second side portion 166. In a similar manner, second lateral gap 312 may extend from first side portion 164, through base portion 162 and into second side portion 166. In particular, first lateral gap 310 may extend through first side periphery 170 and second side periphery 172. Also, second lateral gap 312 may extend through first side periphery 170 and second side periphery 172.

In some embodiments, first lateral gap 310 may separate a front portion 320 of base portion 162 from an intermediate portion 322 of base portion 162. Furthermore, a first end portion 330 of first lateral gap 310 may be spaced apart from first side upper edge 304 and a second end portion 332 of first lateral gap 310 may be spaced apart from second side upper edge 306. Thus, it can be seen that first lateral gap 310 does not completely separate adjacent portions of first side portion 164 or second side portion 166. Likewise, second lateral gap 312 may separate intermediate portion 322 of base portion 162 from a rear portion 324 of base portion 162. Furthermore, a first end portion 340 of second lateral gap 312 may be spaced apart from first side upper edge 304 and a second end portion 342 of second lateral gap 312 may be spaced apart from second side upper edge 306. Thus, it can be seen that second lateral gap 310 does not completely separate adjacent portions of first side portion 164 or second side portion 166.

In some embodiments, first side portion 164 and/or second side portion 166 may further include gaps that extend inwardly from the edges of support member 150. For example, in an exemplary embodiment, first side portion 164 includes a first side gap 350, while second side portion 166 includes a second side gap 352. In some embodiments, first side gap 350 may extend into first side portion 164 from first side upper edge 304. Likewise, second side gap 352 may extend into second side portion 166 from second side upper edge 306.

In some embodiments, first side gap 350 may have a longitudinal position that is between the longitudinal position of first lateral gap 310 and the longitudinal position of second lateral gap 312 (i.e., rearwards of first lateral gap 310 and forwards of second lateral gap 312 with respect to the longitudinal direction). Similarly, in some embodiments, second side gap 352 may have a longitudinal position that is between the longitudinal position of first lateral gap 310 and the longitudinal position of second lateral gap 312 (i.e., rearwards of first lateral gap 310 and forwards of second lateral gap 312 with respect to the longitudinal direction). In other embodiments, however, first side gap 350 could be disposed forwards and/or rearwards of both first lateral gap 310 and second lateral gap 312. Likewise, in other embodiments, second side gap 351 could be disposed forwards and/or rearwards of both first lateral gap 310 and second lateral gap 312.

In some embodiments, the end portions of each gap could vary. In some embodiments, each gap could have a tapering geometry, including a pointed, V-shaped or wedge-like geometry. In an exemplary embodiment, first end portion 330 and second end portion 332 of first lateral gap 310 may have tapered geometries that narrow in width towards first side upper edge 304 and second side upper edge 306, respectively. Likewise, first end portion 340 and second end portion 342 of second lateral gap 312 may have tapered geometries that narrow in width towards first side upper edge 304 and second side upper edge 306, respectively. Finally, in some embodiments, first side gap 350 and second side gap 352 may each have tapered geometries. Specifically, a first end portion 360 of first side gap 350 disposed at first side upper edge 304 may be wider than a second end portion 362 of first side gap 350. Likewise, a first end portion 370 of second side gap 352 disposed at second side upper edge 306 may be wider than a second end portion 364 of second side gap 352.

Generally, the sizes of one or more gaps may vary. In some embodiments, first lateral gap 310 and second lateral gap 312 could have substantially similar widths, where the width of each gap extends along a longitudinal direction of support member 150. In other embodiments, first lateral gap 310 could have a greater width than second lateral gap 312. In still other embodiments, first lateral gap 310 could have a smaller width than second lateral gap 312. Moreover, the width of each gap relative to other portions of sole structure 150 could vary. For example, in one embodiment, first lateral gap 310 and second lateral gap 312 may have widths approximately in the range between 50% to 200% of the width of intermediate portion 322 of base portion 162, which extends between first lateral gap 310 and second lateral gap 312.

The use of gaps in support member 150 may help provide increased flexibility to facilitate natural foot motions as well as increased comfort for a wearer. Specifically, first lateral gap 310 and second lateral gap 312 may facilitate some relative motion or bending between adjacent portions of support member 150, such as front portion 320, intermediate portion 322 and rear portion 324 of support member 150. First side gap 350 and second side gap 352 may also promote or allow for some bending or relative motion between adjacent sections of support member 150. For example, in some embodiments, the presence of first lateral gap 310, second lateral gap 312, first side gap 350 and second side gap 352 all contribute to the ability of support member 150 to bend with a foot during flexure of the foot, such as when the toe is planted and the heel is raised.

Some embodiments of support member 150 may be characterized as having two or more articulating segments. As seen in FIG. 7, in one embodiment, support member 150 may have a first segment 400, a second segment 402 and a third segment 404. Each of first segment 400, second segment 402 and third segment 404 comprise portions of base portion 162, first side portion 164 and second side portion 166. In particular, first segment 400 comprises portions of support member 150 that are disposed forwards of first lateral gap 310. Second segment 402 comprises portions of support member 150 that are disposed between first lateral gap 310 and second lateral gap 312. Third segment 404 comprises portions of support member 150 that are disposed rearwards of second lateral gap 312. Furthermore, first segment 400 and second segment 402 are joined at a first connecting portion 410, which is disposed in first side portion 164, and at a second connecting portion 412, which is disposed in second side portion 166. Second segment 402 and third segment 404 are joined at a third connecting portion 414, which is disposed in first side portion 164, and at a fourth connecting portion 416, which is disposed in second side portion 166. With this arrangement, first segment 400, second segment 402 and third segment 404 may be able to flex about these various connecting portions, thereby providing some degree of bending, twisting or other kinds of flexing in order to accommodate various foot positions and motions.

Figure 9:
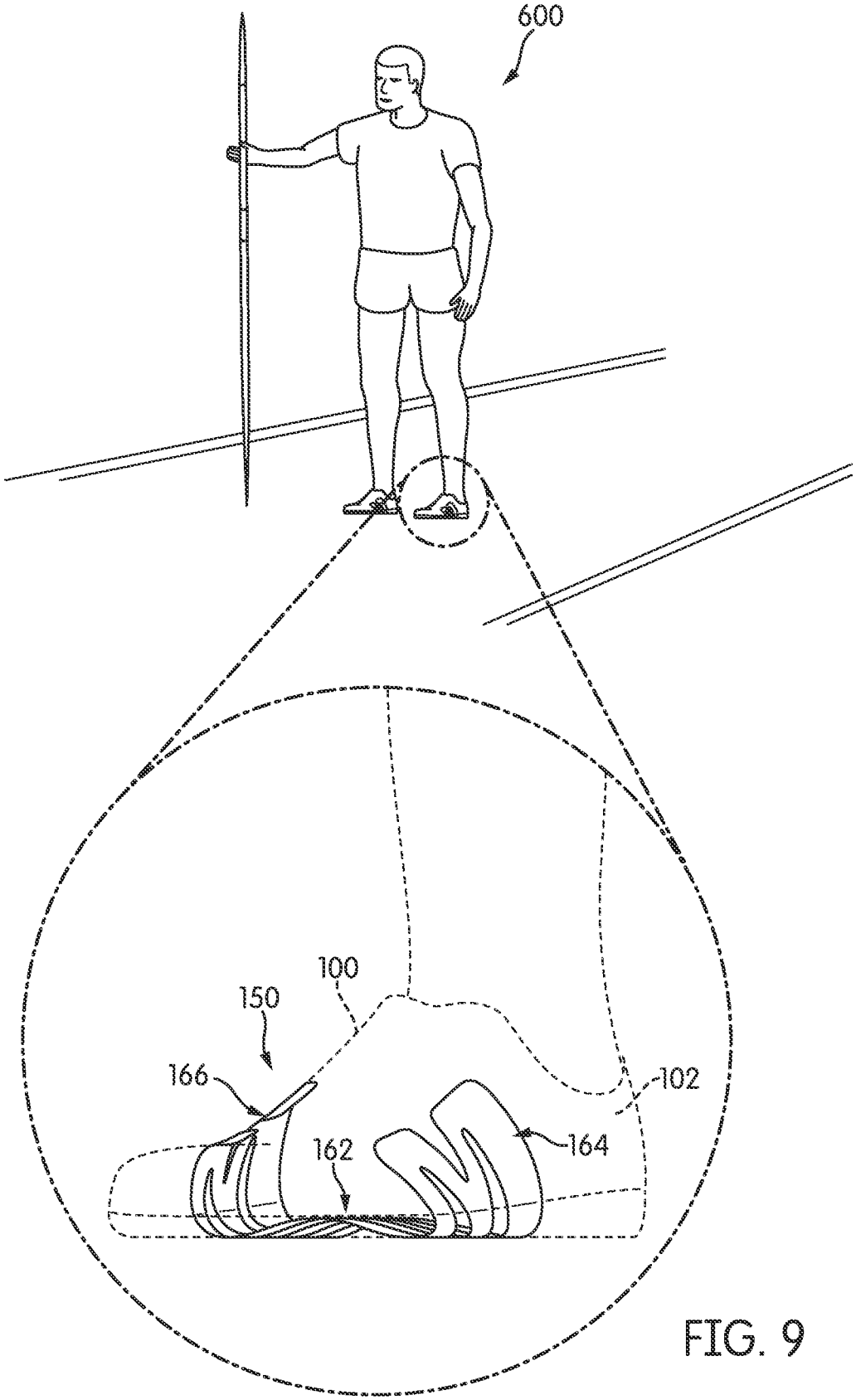
FIG. 9 is a schematic view of a user standing while wearing an article of footwear with a support member, according to an embodiment.
Figure 10:
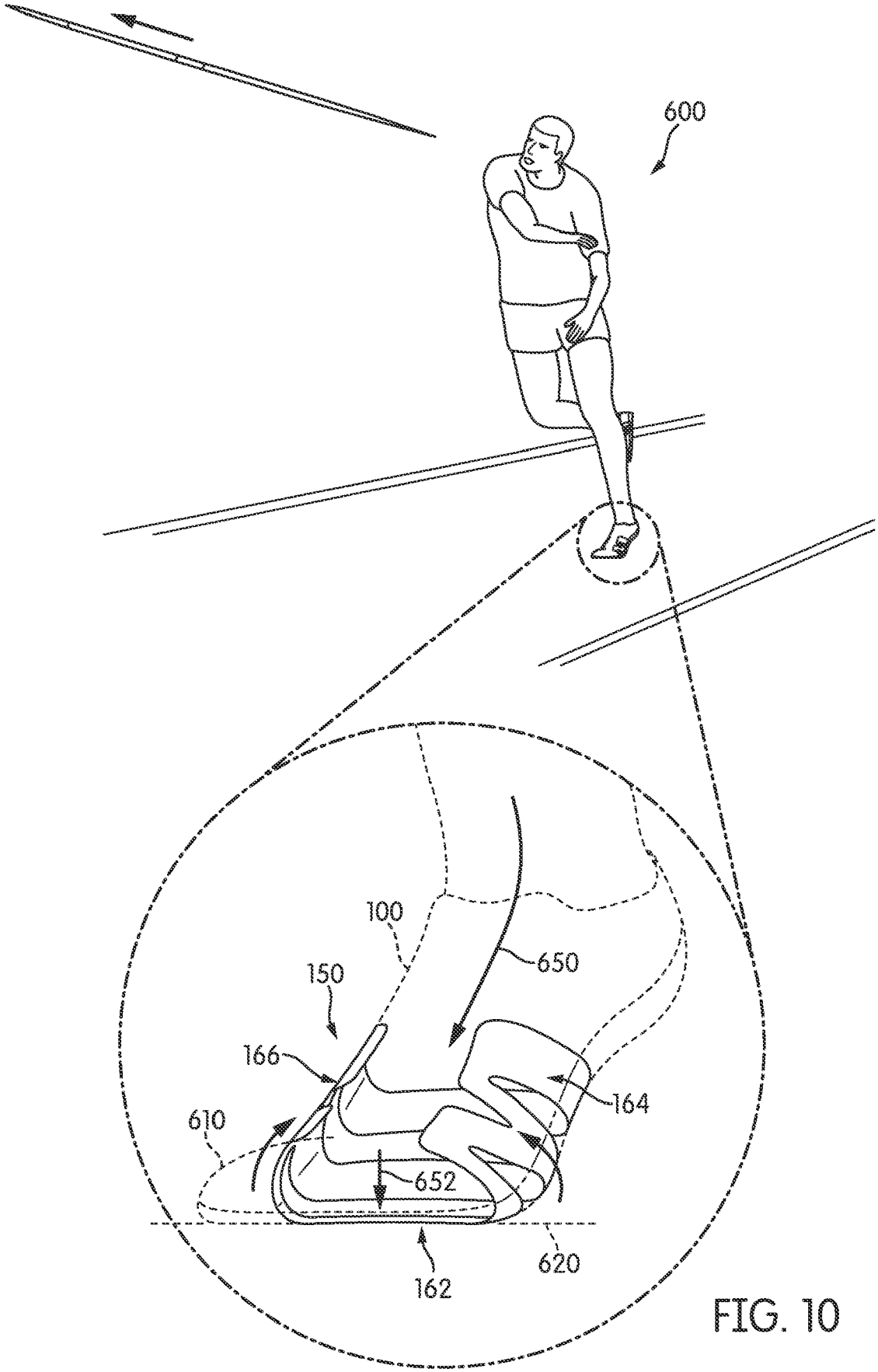
FIG. 10 is a schematic view of a support plate being actuated as a user plants his foot, according to an embodiment.
Figure 11:
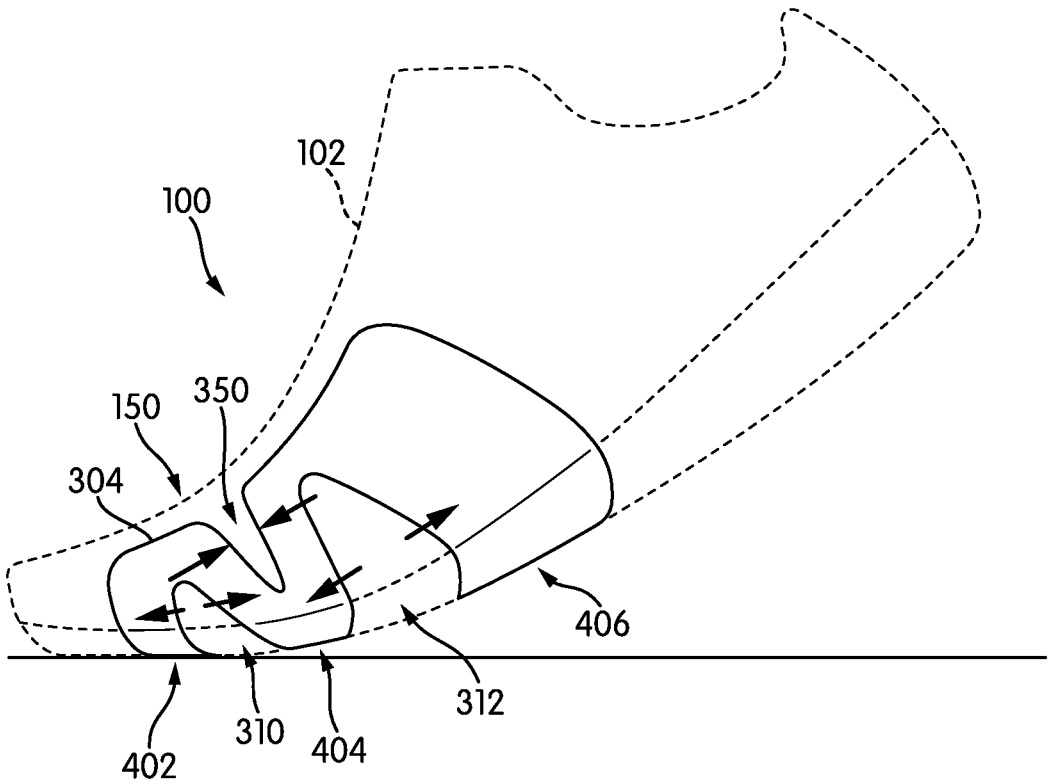
FIG. 11 is a schematic side view of the support plate actuated in FIG. 10 as the user plants his foot, according to an embodiment.

FIGS. 9 through 11 illustrate various configurations of support member 150 during use in a javelin throwing event. In particular, FIG. 9 illustrates support member 150 in a normal configuration, while FIGS. 10 and 11 illustrate different views of support member 150 in an actuated configuration.

Referring to FIG. 9, a user 600 is preparing for a javelin throwing event. At this point, user 600 is standing and the forces applied to base portion 162 by article 100 (and the foot) are not sufficient to actuate or otherwise deflect support member 150. Thus, in this normal configuration, first side portion 164 and second side portion 166 may apply low tension against the sides of article 100. This allows for maximum comfort and fit of article 100 on the foot, while user 600 is not engaged in any essential activities that require enhanced support.

Referring now to FIGS. 10 and 11, user 600 is in the final stage of throwing a javelin. In order to obtain maximum throwing power, user 600 plants forefoot portion 610 of article 100 firmly on ground surface 620. This results in a force 650 being transferred through the leg to the forefoot. The forefoot therefore applies a force 652 down against base portion 162. As base portion 162 is deflected and flattened under the applied force 652, first side portion 164 and second side portion 166 rotate inwardly to apply a clamping force against the sides of upper 102, and therefore to the sides of the foot. The clamping force applied by support member 150 restricts the relative motion of the foot within article 100, thereby increasing stability for the duration of this last stage of throwing (e.g., while the forefoot/toes remain planted and the heel is raised off the ground).

Moreover, as seen in FIG. 11, in some embodiments, the gaps of support member 150 facilitate some bending along the length of support member 150 in order to accommodate the bent position of a foot. Specifically, in some embodiments, first side gap 350 and second side gap 352 (not shown) may allow support member 150 to compress slightly along first side upper edge 304 and second side upper edge 306 (not shown), while first lateral gap 310 and second lateral gap 312 facilitate the longitudinal expansion of base portion 162. In some cases, this provides some relative flexing or movement between first segment 402, second segment 404 and third segment 406 of support member 150. In some cases, this flexing may be facilitated by locating first segment 402 of support member 150 in forefoot portion 610 (see FIG. 10) of article 100 (i.e., beneath a user's forefoot when article 100 is worn) so that first segment 402 can be pressed against the ground during the maneuver. This allows support member 150 to accommodate the natural contouring of the foot during the forefoot planting maneuver, while the lateral deflection facilitates clamping and increased stability.

Such a configuration for support member 150 may be contrasted with an alternative geometry that utilizes no gaps. In such an embodiment, a support member could comprise a solid channel geometry that may provide lateral flexing (e.g., could provide the clamping force) but would resist longitudinal bending and thereby limit the desired foot-planting motion needed to achieve a good javelin or hammer throw.

It will be understood that immediately following the release of the applied force 652, support member 150 may return to the normal, or neutral, configuration (i.e., the unclamped configuration). In some embodiments, this may be achieved by using a resilient material that provides a return force to ensure support member 150 is returned to the normal configuration.

The use of an external support member can further be seen to enhance the comfort and fit of article 100 while the support member is in the neutral or non-deflected configuration. In particular, because upper 102 is disposed between support member 150 and the foot, upper 102 is able to provide the usual degree of comfort and support to a foot while support member 150 is not clamping the sides of the foot. In other words, such an external configuration helps reduce interference with the normal operation of upper 102. In embodiments where a support member is disposed within an upper (e.g., proximal to the upper), the ability of the upper to provide the usual degree of comfort and fit may be decreased by the presence of the support member between the foot and the upper.

Of course, it is to be understood that other embodiments could include support members that are fully internal to an article of footwear or partially internal to the article of footwear. For example, FIG. 11 illustrates an alternative configuration in which a support member 700 is disposed internally (i.e., proximally) to the outer surface of both upper 702 and sole structure 704. In still another embodiment, shown in FIG. 12, a support member 800 is seen to be external on upper 802 and internal or proximal to an outer surface of sole structure 804.

In various embodiments, an upper and/or sole structure could be modified to receive portions of a sole member. For example, in embodiments where a support member is disposed externally on a sole structure, the sole structure could be provided with recesses or channels to receive portions of the support member. By receiving portions of the support member into recesses or channels on the outer surface of the sole structure, the support member can be made flush (or approximately flush) with the outer surface of the sole structure (such as the outsole). In still other embodiments, such as the example shown in FIG. 13, an interior portion of a sole structure may include cavities, recesses or channels to receive portions of a support member.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear comprising:

an upper having an outer surface; and a support member including (i) a base portion extending from a medial side of the upper to a lateral side of the upper and defining a convex surface facing the outer surface of the upper in a forefoot region of the upper when the base portion is in an unloaded state, (ii) a first side portion extending around the upper and defining a first side axis extending from the base portion to a first side upper edge at the medial side, and (iii) a second side portion extending around the upper and defining a second side axis extending from the base portion to a second side upper edge at the lateral side, the first side axis and the second side axis being continuously convergent with one another in a direction extending away from the base portion.

2. The article of footwear of claim 1, wherein at least one of the first side portion and the second side portion opposes the base portion to define an opening between the base portion and the at least one of the first side portion and the second side portion.

3. The article of footwear of claim 2, wherein the upper is disposed within the opening.

4. The article of footwear of claim 1, wherein the support member is formed from a material having a higher rigidity than a material forming the upper.

5. The article of footwear of claim 1, wherein the support member defines a first gap extending along the base portion.

6. The article of footwear of claim 5, wherein the first gap extends into at least one of the first side portion and the second side portion.

7. The article of footwear of claim 6, wherein the first gap tapers to a distal end at the at least one of the first side portion and the second side portion.

8. The article of footwear of claim 5, wherein the support member defines a second gap extending along the base portion, the second gap being spaced apart from the first gap in a direction extending along a longitudinal axis of the article of footwear.

9. The article of footwear of claim 8, wherein the second gap extends into at least one of the first side portion and the second side portion.

10. An article of footwear comprising:

an upper having an outer surface; and a support member including (i) a base portion extending from a medial side of the upper to a lateral side of the upper and defining a concave surface facing away from the outer surface of the upper in a forefoot region of the upper when the base portion is in an unloaded state, (ii) a first side portion defining a first side axis extending from the base portion to a first side upper edge at the medial side, and (iii) a second side portion defining a second side axis extending from the base portion to a second side upper edge at the lateral side, the first side axis and the second side axis extending continuously toward one another in a direction extending away from the base portion and over the forefoot region of the upper.

11. The article of footwear of claim 10, wherein at least one of the first side portion and the second side portion opposes the base portion to define an opening between the base portion and the at least one of the first side portion and the second side portion.

12. The article of footwear of claim 11, wherein the upper is disposed within the opening.

13. The article of footwear of claim 10, wherein the support member is formed from a material having a higher rigidity than a material forming the upper.

14. The article of footwear of claim 10, wherein the base portion extends along an underfoot surface of the article of footwear.

15. The article of footwear of claim 10, wherein the support member defines a first gap extending along the base portion.

16. The article of footwear of claim 15, wherein the first gap extends into at least one of the first side portion and the second side portion.

17. The article of footwear of claim 16, wherein the first gap tapers to a distal end at the at least one of the first side portion and the second side portion.

18. The article of footwear of claim 15, wherein the support member defines a second gap extending along the base portion, the second gap being spaced apart from the first gap in a direction extending along a longitudinal axis of the article of footwear.

19. The article of footwear of claim 18, wherein the second gap extends into at least one of the first side portion and the second side portion.

* * * * *